US010598433B2

(12) United States Patent
Bria et al.

(10) Patent No.: US 10,598,433 B2
(45) Date of Patent: Mar. 24, 2020

(54) REMOTE NOZZLE DECKLE SYSTEM

(71) Applicant: Babcock & Wilcox MEGTEC, LLC, De Pere, WI (US)

(72) Inventors: Michael P Bria, Green Bay, WI (US); Nicholas J Klika, Green Bay, WI (US); Timothy M Rosenberg, Wrightstown, WI (US)

(73) Assignee: Durr Systems, Inc., DePere, WI (US)

( * ) Notice: Subject to any disclaimer, the term of this patent is extended or adjusted under 35 U.S.C. 154(b) by 186 days.

(21) Appl. No.: 15/091,918

(22) Filed: Apr. 6, 2016

(65) Prior Publication Data

US 2016/0298903 A1 Oct. 13, 2016

Related U.S. Application Data

(60) Provisional application No. 62/146,227, filed on Apr. 10, 2015.

(51) Int. Cl.

| | |
|---|---|
| ***F26B 5/00*** | (2006.01) |
| ***F26B 13/10*** | (2006.01) |
| ***F26B 13/20*** | (2006.01) |
| ***F26B 21/00*** | (2006.01) |

(52) U.S. Cl.

CPC ..... *F26B 13/108* (2013.01); *F26B 13/104* (2013.01); *F26B 21/004* (2013.01)

(58) Field of Classification Search

CPC ..... F26B 13/108; F26B 13/104; F26B 17/10; F26B 21/004; F26B 21/028; Y10T 137/87507; Y10T 137/8741; Y10T 137/87265; Y10T 137/87515

USPC ..... 34/643, 644, 414, 444, 446, 611, 612; 137/601.14, 601.01, 601.12, 599.01; 219/482, 485, 483, 476, 479, 551, 397

See application file for complete search history.

(56) References Cited

U.S. PATENT DOCUMENTS

| | | | | |
|---|---|---|---|---|
| 3,994,315 | A * | 11/1976 | Muller | C21B 9/12 137/601.01 |
| 4,312,139 | A * | 1/1982 | Preisler | F26B 13/007 34/571 |
| 4,530,167 | A * | 7/1985 | Hotovy | A23B 9/08 34/233 |
| 4,901,449 | A | 2/1990 | Wimberger | |
| 5,419,021 | A | 5/1995 | Seroogy | |
| 6,202,323 | B1 * | 3/2001 | Moller | F26B 13/10 34/631 |

(Continued)

*Primary Examiner* — John P McCormack

(74) *Attorney, Agent, or Firm* — Nields, Lemack & Frame, LLC

(57) ABSTRACT

Seal member for a nozzle or an air bar, that is configured and can be positioned to block at least a portion of the flow of air (or gas) exiting or discharged from the nozzle or air bar into the interior of a housing such as a dryer or the like. Each seal member can be actuated externally of the housing interior, without requiring physical access to the housing interior, to move it into air flow blocking relation with a nozzle, and to move it out of air flow blocking relation with a nozzle. Each seal member can be actuated while the apparatus remains in an operating mode. Also disclosed is a method of controlling or regulating the amount of air emitted or discharged from one or more nozzles in a housing by blocking air flow discharged from the one or more nozzles with a seal member.

22 Claims, 9 Drawing Sheets

(56) References Cited

U.S. PATENT DOCUMENTS

| | | | | |
|---|---|---|---|---|
| 6,207,020 | B1 * | 3/2001 | Anderson | D21G 1/0093 162/204 |
| 9,365,965 | B2 * | 6/2016 | West | D06B 3/22 |
| 2003/0056911 | A1 * | 3/2003 | Hermans | D21F 1/48 162/101 |
| 2011/0198426 | A1 * | 8/2011 | Piotrowski | E04F 21/085 241/101.71 |

* cited by examiner

SEALS CLOSED

SEALS OPEN

SEALS CLOSED

SEALS OPEN

BLANK-OFF SEAL FOR MULTIPLE NOZZLES

REMOTE NOZZLE DECKLE SYSTEM

This application claims priority of U.S. Provisional Application Ser. No. 62/146,227 filed Apr. 10, 2015 and titled "Remote Nozzle Deckle System", the disclosure of which is hereby incorporated by reference as if it was fully set forth herein in its entirety.

FIELD

Embodiments disclosed herein relate to a web handling apparatus and a method of controlling or regulating the amount of air emitted or discharged from one or more nozzles in a housing.

BACKGROUND

Web handling apparatus such as dryers for running webs usually include a closed housing forming one or more drying chambers or zones having a plurality of spaced nozzles, the nozzles usually arranged in an upper and lower array with a web running between them. The traveling web enters the housing through a narrow entrance slot, is acted on by gas (e.g., air) ejected from each of the nozzles, and then exits the housing through a discharge slot. The working air is usually supplied from an outside source or sources, is heated and is then supplied to the nozzles via headers, and the nozzles eject the air into the dryer chamber(s).

In web coating, printing and drying operations, it is often desirable that the web have contactless support, in order to avoid damage to the web itself or to the wet coating (such as ink) previously applied to one or more surfaces of the web. One conventional arrangement for contactlessly supporting a web during drying includes the aforementioned horizontal upper and lower sets of nozzles or air bars in a dryer between which the web travels. Hot air issuing from the air bars both dries and supports the web as it travels through the dryer. The dryer housing can be maintained at a slightly sub-atmospheric pressure by an exhaust blower or the like that draws off the moisture or other volatiles emanating from the web as a result of the drying of the water, coating or ink thereon, for example.

Manufacturers often produce products of varying width that require drying inside the dryer housing. Drying is a high energy use process and reducing the heated air flow inside the dryer for narrow width products may offer a quality improvement to the product and/or reduce energy use for the process by reducing the total heated air flow inside the dryer. However, accessing the interior of the dryer to modify the internals in an effort to optimize energy consumption is difficult and time-consuming. It also requires shutting down the dryer, which results in unnecessary downtime and production inefficiencies.

It therefore would be desirable to provide varying nozzle widths in a web handling apparatus housing without having to access the housing interior. It also would be desirable to do so while the unit continues to operate; e.g., "on the fly" without having to shut the unit down or temporarily pause operation, as well as providing safe operation of the unit.

SUMMARY

Problems of the prior art have been overcome by the embodiments disclosed herein, which include a seal member for a nozzle or an air bar, that is configured and can be positioned to block at least a portion of the flow of air (or gas) exiting or discharged from the nozzle or air bar into the interior of a housing such as a dryer or the like.

One embodiment of the invention comprises a web handling apparatus comprising a housing; at least one nozzle in said housing, said at least one nozzle having a discharge opening for discharging air; and at least one seal member movable between a first position where said seal member blocks a first region of said discharge opening in said at least one nozzle and a second position where said seal member does not block said discharge opening in said at least one nozzle.

Another embodiment of the invention comprises a method of controlling the air emitted from a nozzle in a housing, comprising: (a.) providing a housing defining a chamber; (b.) providing a source of air; (c.) providing at least one nozzle in said housing in fluid communication with said source of air, said at least one nozzle having a discharge opening for discharging air into said chamber; (d.) providing a seal member in said housing; and (e.) moving said seal member into position with respect to said nozzle to block a portion of said air discharged through said discharge opening.

In certain embodiments, each seal member can be actuated externally of the housing interior, i.e., without requiring physical access to the housing interior, to move it into air flow blocking relation with a nozzle, and to move it out of air flow blocking relation with a nozzle. In certain embodiments, each seal member can be actuated while the apparatus remains in an operating mode. The seal member(s) and actuators can be retrofitted into existing apparatus.

Also disclosed is a method of controlling or regulating the amount of air emitted or discharged from one or more nozzles in a housing by blocking air flow discharged from the one or more nozzles with a seal member.

Sealing unneeded regions of nozzle discharge openings, to accommodate webs of smaller widths, for example, can lower system air volume requirements and operating costs.

These and other non-limiting aspects and/or objects of the disclosure are more particularly described below. For a better understanding of the embodiments disclosed herein, reference is made to the accompanying drawings and description forming a part of this disclosure.

BRIEF DESCRIPTION OF THE DRAWINGS

The invention may take form in various components and arrangements of components, and in various process operations and arrangements of process operations. The drawings are only for purposes of illustrating preferred embodiments and are not to be construed as limiting the invention. The foregoing and other aspects will become apparent to those skilled in the art to which the present examples relate upon reading the following description with reference to the accompanying drawings, in which.

DETAILED DESCRIPTION

Figure 1:
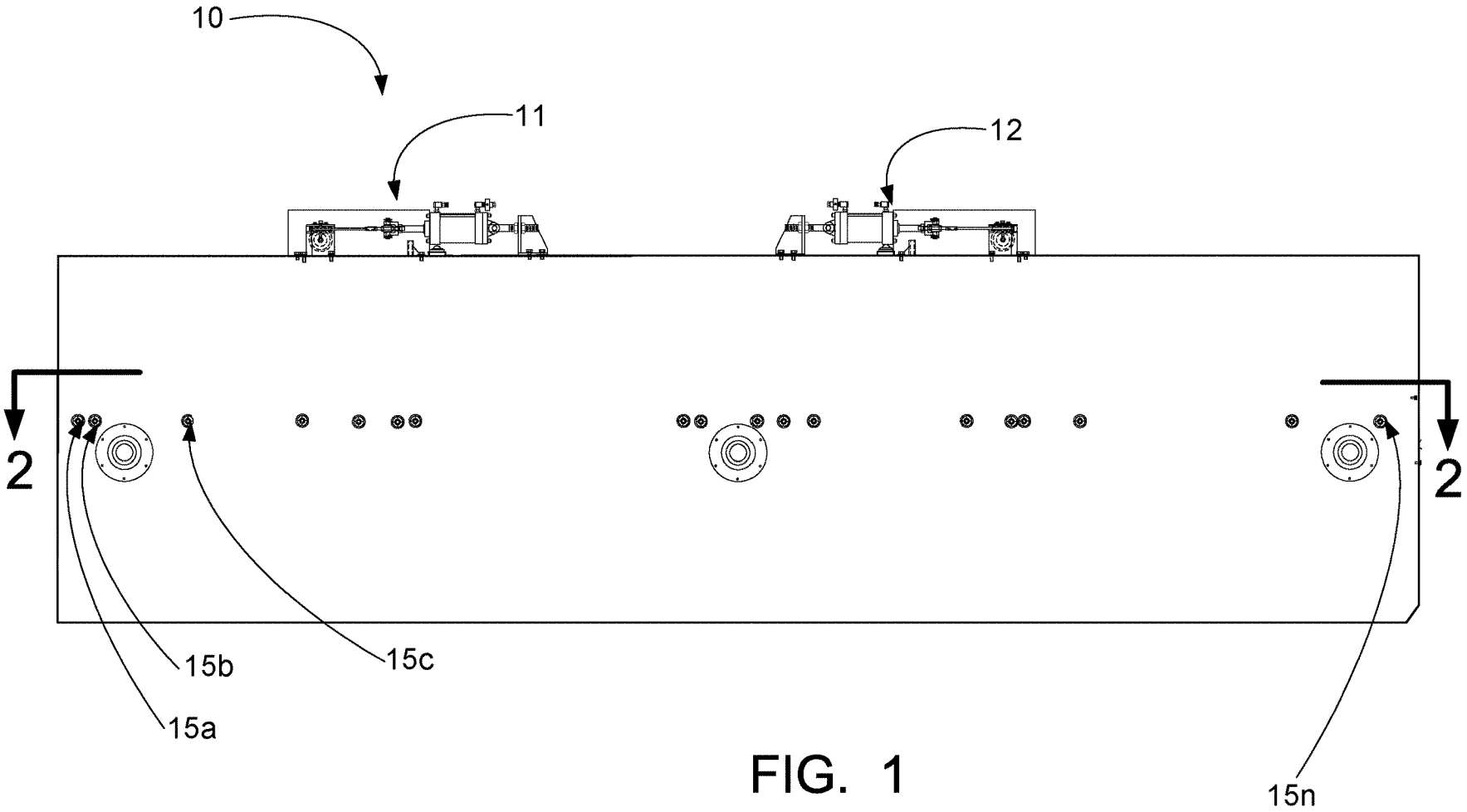
FIG. 1 is a front view (operator side) of a dryer housing in accordance with certain embodiments.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification, various devices and parts may be described as "comprising" other components. The terms "comprise(s)," "include(s)," "having," "has," "can," "contain(s)," and variants thereof, as used herein, are intended to be open-ended transitional phrases, terms, or words that do not preclude the possibility of additional components.

All ranges disclosed herein are inclusive of the recited endpoint and independently combinable (for example, the range of "from 2 inches to 10 inches" is inclusive of the endpoints, 2 inches and 10 inches, and all the intermediate values).

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. The modifier "about" should also be considered as disclosing the range defined by the absolute values of the two endpoints. For example, the expression from about 2 to about 4" also discloses the range "from 2 to 4."

It should be noted that many of the terms used herein are relative terms. For example, the terms "upper" and "lower" are relative to each other in location, i.e. an upper component is located at a higher elevation than a lower component, and should not be construed as requiring a particular orientation or location of the structure.

The terms "top" and "bottom" are relative to an absolute reference, i.e. the surface of the earth. Put another way, a top location is always located at a higher elevation than a bottom location, toward the surface of the earth.

The terms "horizontal" and "vertical" are used to indicate direction relative to an absolute reference, i.e. ground level. However, these terms should not be construed to require structures to be absolutely parallel or absolutely perpendicular to each other.

Although the embodiments disclosed herein are not limited to any particular nozzle design, in certain embodiments the nozzle(s) may be flotation nozzle(s) which exhibit the Coanda effect such as the HI-FLOAT® air bar commercially available from MEGTEC Systems, Inc. (also known as Babcock & Wilcox MEGTEC), which exhibit high heat transfer and excellent flotation characteristics. Standard 1× HI-FLOAT® air bars are characterized by a spacing between slots of 2.5 inches; a slot width of 0.070 to 0.075 inches, usually 0.0725 inches; an installed pitch of 10 inches; and a web-to-air bar clearance of ⅛ inch. Air bar size can be larger or smaller. For example, air bars ½, 1.5, 2 and 4 times the standard size can be used. Air bars 2 times the standard size are characterized by a slot distance of 5 inches and slot widths of 0.140 to 0.145 inches (available commercially as "2× air bars" from MEGTEC Systems, Inc. (also known as Babcock & Wilcox MEGTEC). In general, the greater distance between the slots results in a larger air pressure pad between the air bar and the web, which allows for increasing the air bar spacing. Another suitable flotation nozzle that can be used is the Tri-Flotation air bar disclosed in U.S. Pat. No. 4,901,449, the disclosure of which is hereby incorporated by reference. In a typical dryer configuration with such Coanda flotation nozzles, upper and lower opposing nozzle arrays are provided, with each nozzle in the lower array (except for an end nozzle) positioned between two nozzles in the upper array; i.e., the upper and lower nozzles are staggered with respect to each other.

Suitable nozzles also include direct impingement nozzles, such as direct impingement nozzles having a plurality of apertures, such as a hole-array bar, or direct impingement nozzles having one or more slots, which provide a higher heat transfer coefficient for a given air volume and nozzle velocity than a flotation nozzle. As between the hole-array bar and the slot bar, the former provides a higher heat transfer coefficient for a given air volume at equal nozzle velocities. Although maximum heat transfer is obviously a goal of any dryer system, other considerations such as air volume, nozzle velocity, air horsepower, proper web flotation, dryer size, web line speed, etc., influence the extent to which optimum heat transfer can be achieved, and thus the appropriate design of the direct impingement nozzle. In certain embodiments, the top surface of the direct impingement nozzle may be crown shaped, approaching a central apex at about a 5 degree angle. This design encourages the return air to flow over the edges of the nozzle after impingement on the web. The angle of the crown can vary from about 0 degrees to about 10 degrees. In general, the closer the nozzle is to the web, the larger the angle of the crown.

In certain embodiments, one or more nozzles 20 is an elongated member having one or more discharge openings 21 for emitting air (see FIG. 1), such as an elongated slot, or a plurality of apertures. Each nozzle may include an air-receiving compartment that is in air-receiving communication with a header, which in turn receives air from a suitable source. In the case of a hole bar, the air emits from the hole bar via a plurality of apertures, such as spaced circular holes in the top surface of the hole bar. In the case of a slot bar, air emits from the slot bar via a single, usually centrally located, slot in the top surface of the slot bar, or by two or more discontinuous slots. All of the nozzles in the unit housing need not be identical; for example, the dryer may include combinations of flotation nozzles and direct impingement nozzles. In a typical dryer configuration that utilizes both flotation nozzles and direct impingement nozzles, the flotation nozzles can be in one array, and the direct impingement nozzles in an opposing array. The direct impingement nozzles can be positioned in a staggered relation to the flotation nozzles, e.g., such that each direct impingement nozzle is positioned between two flotation nozzles (i.e., no direct impingement nozzle directly opposes a flotation nozzle, and vice versa). In a typical dryer configuration that utilizes all direct impingement nozzles, each direct impingement nozzles in the upper array may directly oppose a direct impingement nozzle in a lower array (i.e., they are not staggered).

Turning now to FIG. 1, there is shown a front view (operator side) of a web dryer housing or enclosure 10 in accordance with certain embodiments. Although reference is made to a dryer, it should be understood that the embodiments disclosed herein are not limited to dryer applications; web handling apparatus where no drying takes place also falls within the scope of this disclosure. In certain embodiments, the dryer housing 10 houses upper and lower nozzle assemblies, each including a header for supplying air to the nozzles. These assemblies are retractable with respect to each other, primarily to allow a web to be threaded through the housing 10, and also to allow for the periodic maintenance and replacement of the nozzles and other dryer internals. Actuators 11 and 12 are shown for retracting a nozzle assembly within the dryer housing, as indicated by the retraction motion arrow in FIG. 7 for upper nozzle assembly 8. Also shown are a plurality of actuators 15*a*-15*n* for actuating the seal members as discussed in greater detail below.

Figure 2:
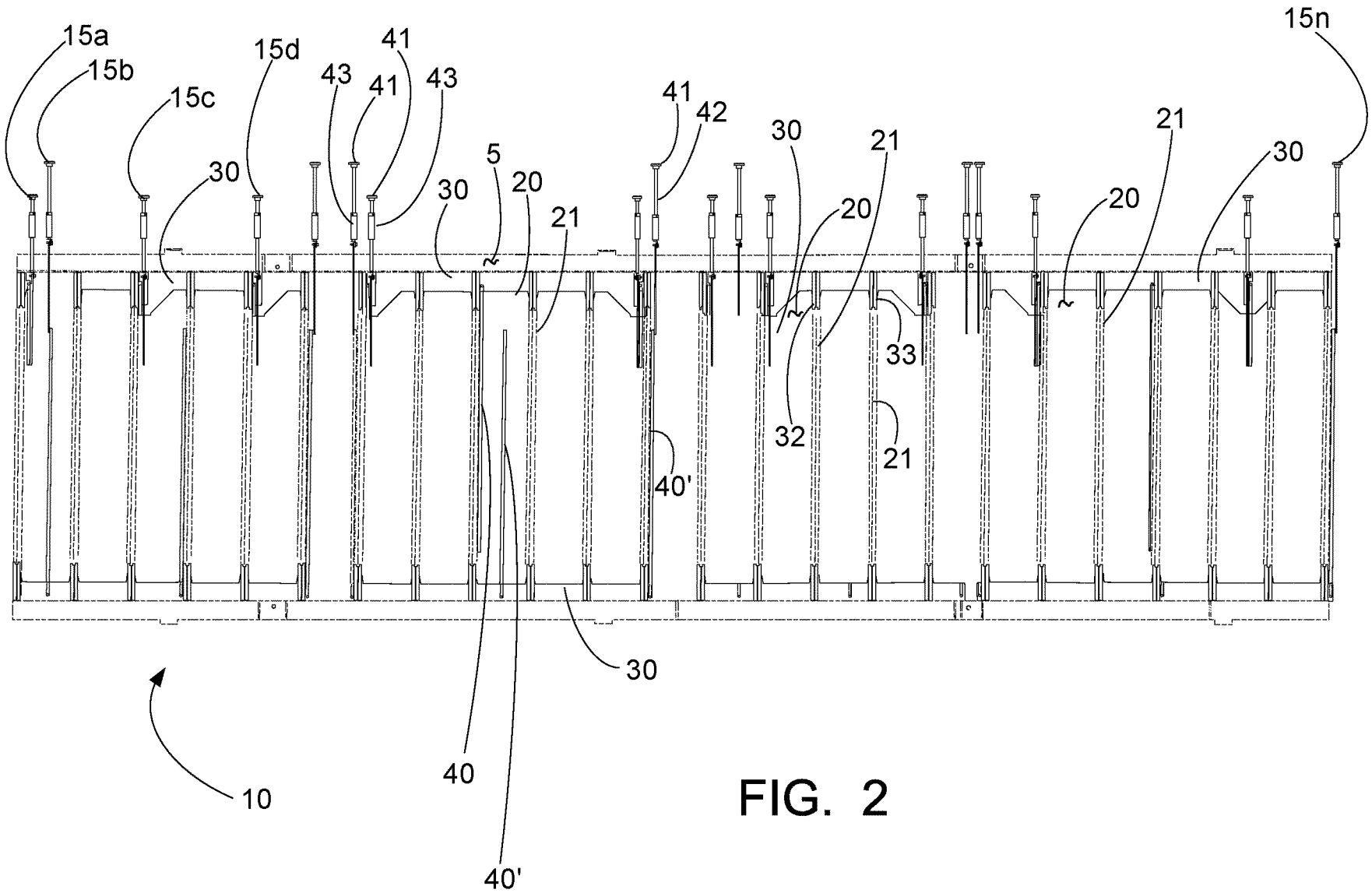
FIG. 2 is a top view, partially in cross-section, of the dryer housing of FIG. 1 taken along line 2-2.

FIG. 2 illustrates a lower nozzle assembly in a dryer housing 10 in accordance with certain embodiments. Each of the actuators 15*a*-15*n* penetrate the dryer wall 5, and thus enable, from outside of the dryer housing 10, manipulation of the seal members that are internal to the dryer housing 10. In certain embodiments, the dryer wall 5 is insulated. A plurality of elongated nozzles 20 of the lower nozzle assembly are shown, each having a discharge opening 21 in the form of a continuous elongated nozzle slot. Other discharge opening configurations are within the scope of the embodiments disclosed herein. For example, although each nozzle 20 as shown includes a single centrally located elongated continuous slot, the nozzle could include more than one slot, discontinuous slots, one or more slots that are not centrally located on the nozzle 20, etc. Similarly, the discharge opening 21 could be one or more apertures, such as circular holes.

Figure 3A:
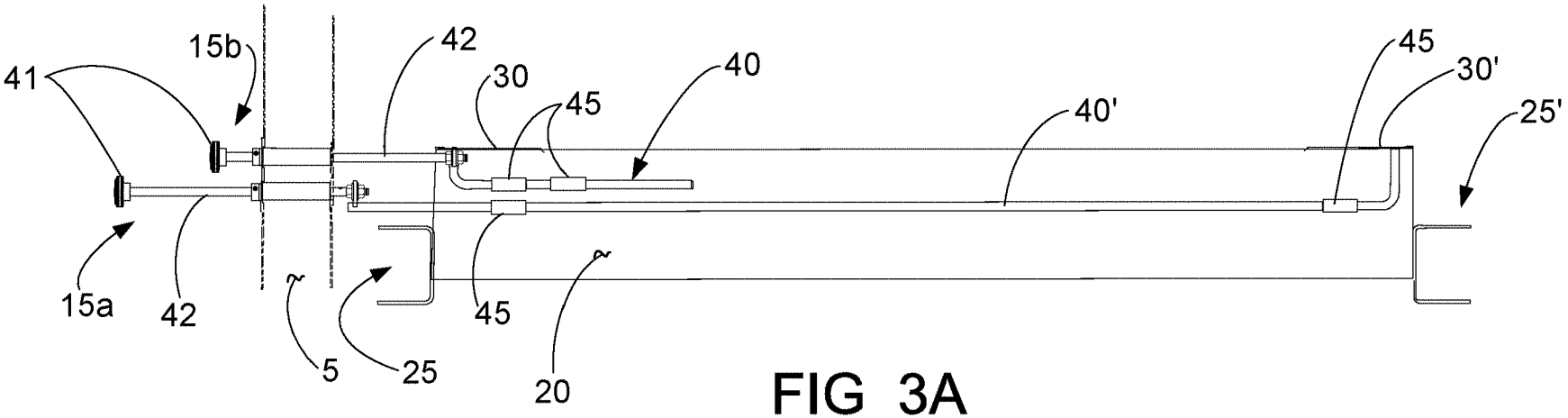
FIG. 3A is a cross-web view of a nozzle of a bottom header nozzle assembly housed in a dryer and including a seal in a closed position in accordance with certain embodiments.
Figure 3B:
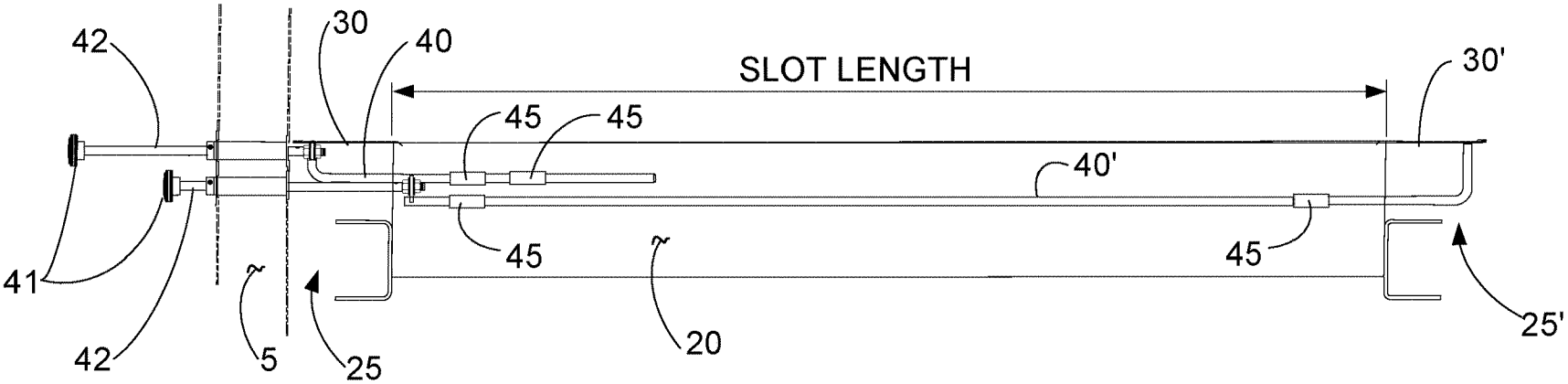
FIG. 3B is a cross-web view of a nozzle of a bottom header nozzle assembly housed in a dryer and including a seal in an open position in accordance with certain embodiments.
Figure 4A:
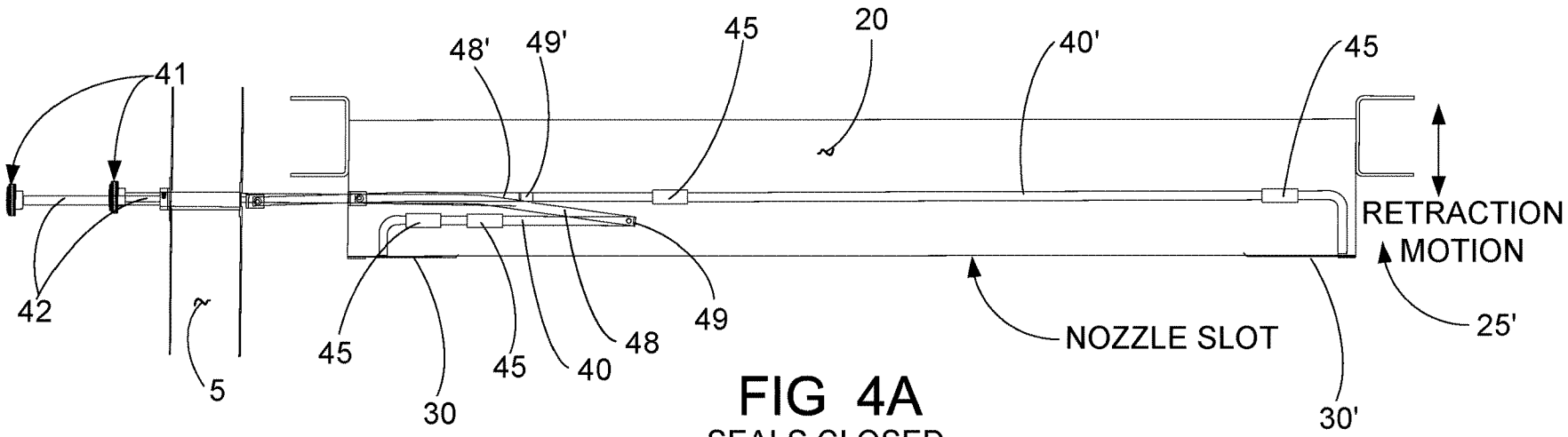
FIG. 4A is a cross-web view of a nozzle of a top header nozzle assembly housed in a dryer and including a seal in a closed position in accordance with certain embodiments.
Figure 4B:
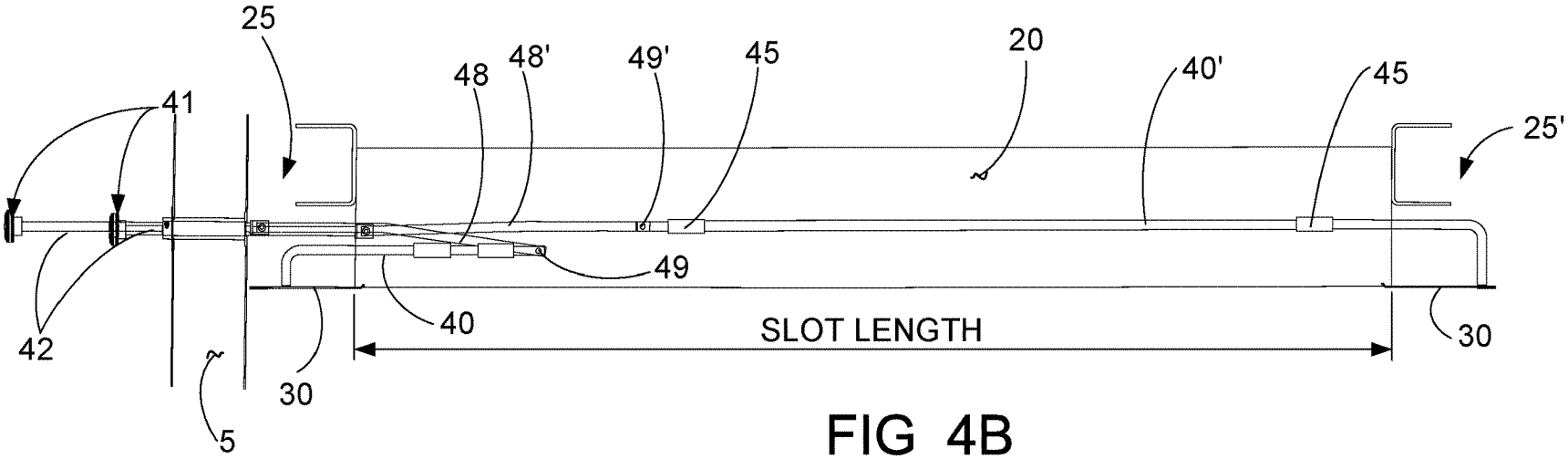
FIG. 4B is a cross-web view of a nozzle of a top header nozzle assembly housed in a dryer and including a seal in an open position in accordance with certain embodiments.

As shown in FIGS. 3A and 4A, in certain embodiments both ends of each nozzle 20 are spaced away from the dryer walls 5, defining a gap 25, 25' between the interior surface of wall 5 and a side edge of the nozzle 20. The gap 25 proximate the operator side of the dryer housing 10 can accommodate seal member 30 when the seal member 30 is in the fully open position, and the gap 25' proximate the gear side of the dryer housing 10 can accommodate seal member 30' when the seal member 30' is in the fully open position, as can be seen in FIGS. 3B and 4B.

Figures 5A, 5B:
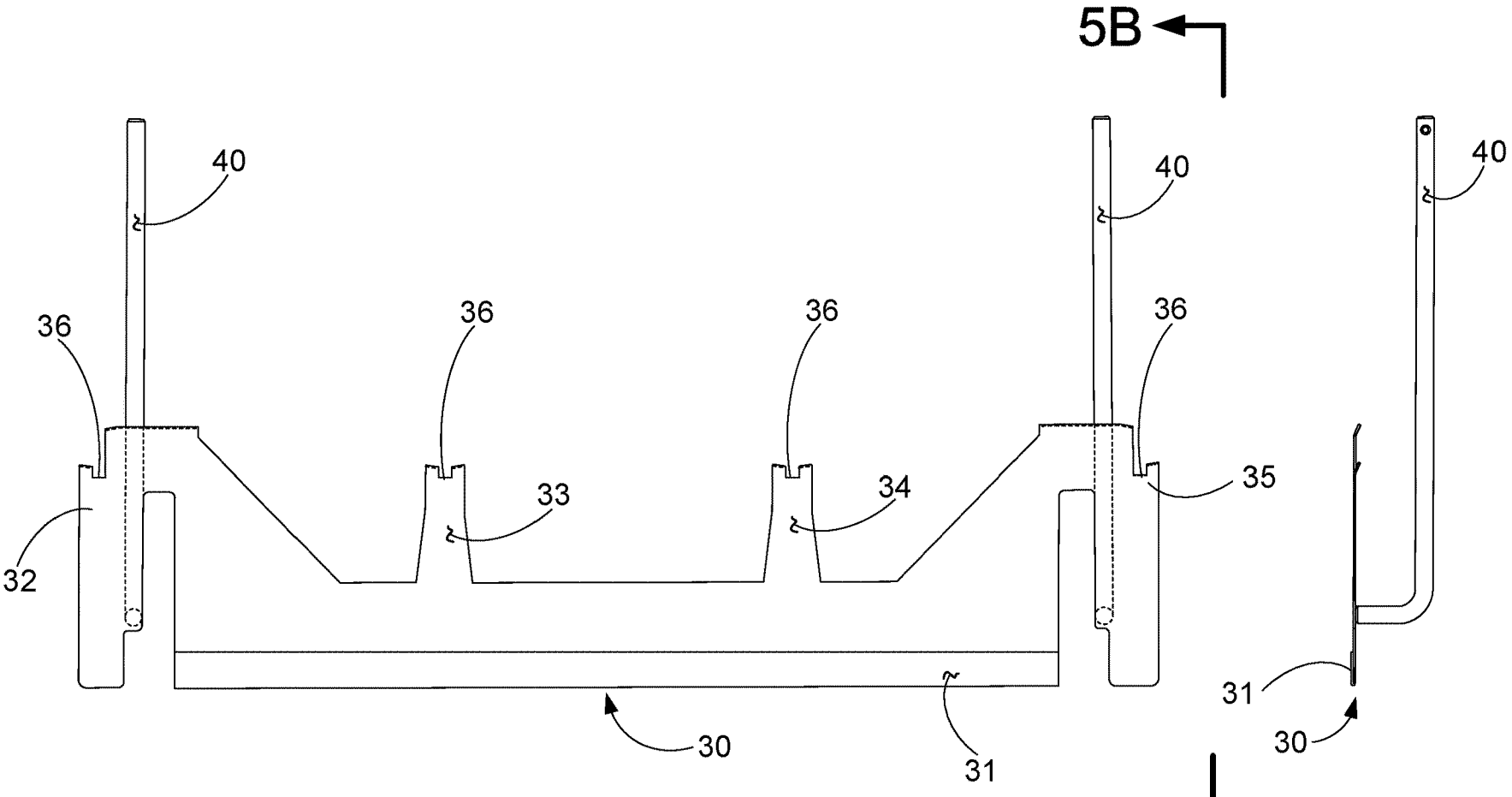
FIG. 5A is a top view of a seal member in accordance with certain embodiments.
FIG. 5B is a side view of the seal member of FIG. 5A.

FIGS. 5A and 5B show a suitable seal member 30 in accordance with certain embodiments. The seal member 30 shown is suitable for blocking air flow from regions of the discharge openings 21 of multiple nozzles 20 simultaneously. Those skilled in the art will appreciate that the seal member 30 can be designed to block air flow from a portion of a discharge opening 21 in a single nozzle or in two or more nozzles simultaneously, depending in part on the design of the nozzle assembly, the spacing between nozzles, whether it is desirable to allow the operator to reach two actuators simultaneously, etc.

In certain embodiments, the seal member 30 is a metal plate, such as stainless steel, and includes a bottom region 31 that can be reinforced such as by folding the plate against itself, as best seen in FIG. 5B. In certain embodiments, the seal member 30 is substantially planar. In the embodiment shown, the seal member 30 includes spaced blocking fingers 32, 33, 34 and 35 which are configured to block air flow from portions of respective discharge openings 21 on adjacent nozzles 20. Those skilled in the art will appreciate that fewer or more blocking fingers can be provided on each seal member. The spacing between blocking fingers 32, 33, 34 35 corresponds to the spacing between nozzle discharge openings 21. In the embodiment shown, the spacing between blocking fingers is equidistance, as the spacing between discharge openings 21 in adjacent nozzles is equidistant. In certain embodiments, the free end of each blocking finger 32, 33, 34, 35 can include a notch 36, which may be present to ensure that the nozzle discharge opening 21 is completely exposed when the seal member 30 is retracted to the fully open position (FIG. 3B or FIG. 4B). In certain embodiments, the geometry of the notch 36 matches the geometry of the discharge opening 21. In the embodiment shown, the discharge opening 21 is an elongated slot having substantially the same width as the width of the notch 36. In certain embodiments, the free end of each blocking finger 32, 33, 34 and 35 is preferably bent (FIG. 5B) toward the discharge opening 21 of the nozzle when in the assembled and seal closed position, to facilitate seating the seal member in position on the nozzle 20. The foregoing description of seal member 30 applies to seal member 30' as well.

The length of each blocking finger 32, 33, 34, 35 is a function of the extent of the air flow blockage of the nozzle discharge opening 21 desired. This depends in part on the width of the web travelling through the dryer housing 10, and thus how much discharge opening area is desired for floating and/or drying the web. For example, in certain embodiments where the overall nozzle length is 57 inches, each seal member 30, 30' can block up to 6 inches of the nozzle discharge opening 21 at each end of the nozzle 20. Accordingly, in this example, each seal member 30, 30' can be positioned to block anywhere from 0 to 6 inches of discharge opening in each nozzle by partially or fully retracting each seal member from its fully closed position (FIG. 3A OR FIG. 4A), and thus can be suitably positioned depending upon the width of the web in the dryer housing 10.

Figure 9:
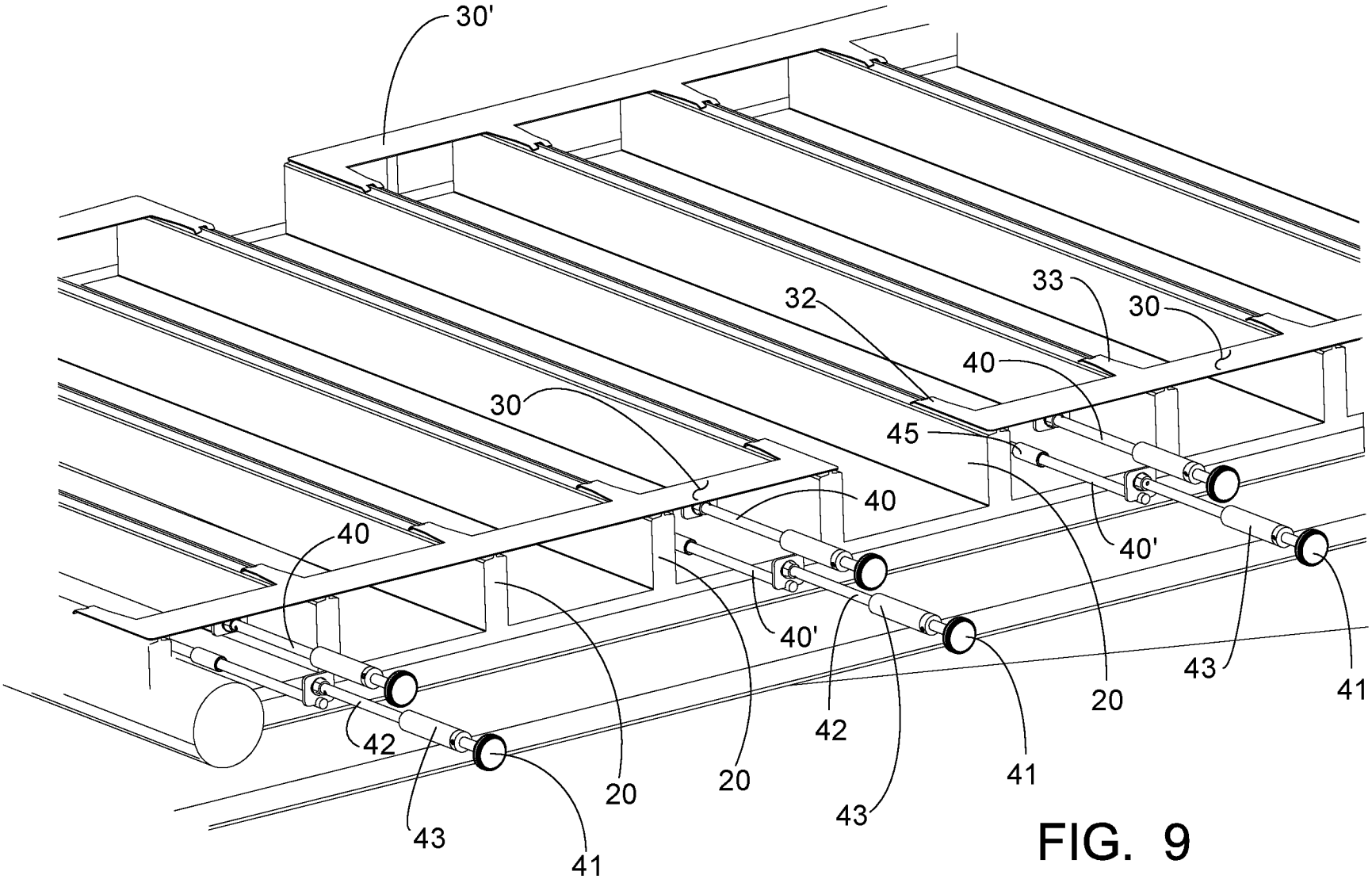
FIG. 9 is a perspective view of a nozzle assembly in accordance with certain embodiments.

In certain embodiments, one or more actuator rods 40 are coupled to the seal member 30, such as by welding. Similarly, one or more actuator rods 40' are connected to seal member 30', such as by welding. In the embodiments shown in FIGS. 3A and 4A, there are two actuator rods 40 coupled to each seal member 30, each coupled near a side edge of the seal member 30, so that the seal member 30 can be actuated evenly (e.g., without skewing). Fewer or more actuator rods 40, 40' could be used for each seal member 30, 30'. Where the seal member is designed to block air flow from several nozzles, a center actuator rod 40, 40' can be used to help align the member and maintain a tight seal with the discharge opening as shown in FIG. 2. Each actuator rod 40 is coupled to an actuator assembly 15 by any suitable means, as seen in FIG. 3A and FIG. 4A, for example. In certain embodiments, each actuator rod 40 is accommodated in the space between nozzles 20 (FIG. 9). In certain embodiments, each actuator rod 40 is substantially L-shaped, as seen in FIG. 5B. Actuator rods 40' are similar to actuator rods 40, except the former are longer in order reach the discharge openings of the nozzles 20 proximate to the gear side of the dryer housing 10.

Figure 6B:
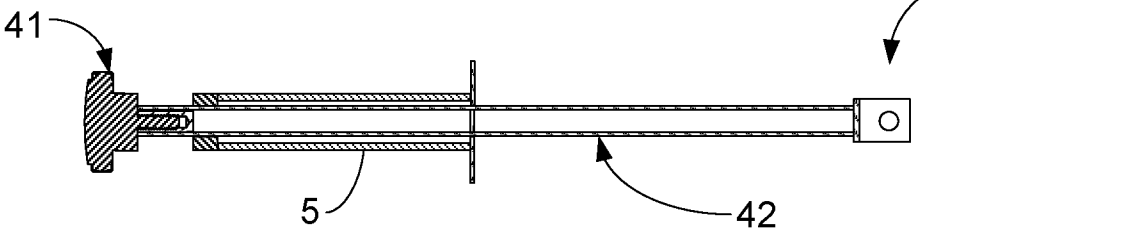
FIG. 6B is a cross-sectional view, taken along line A-A, of the actuating assembly of FIG. 6A.
Figure 6A:
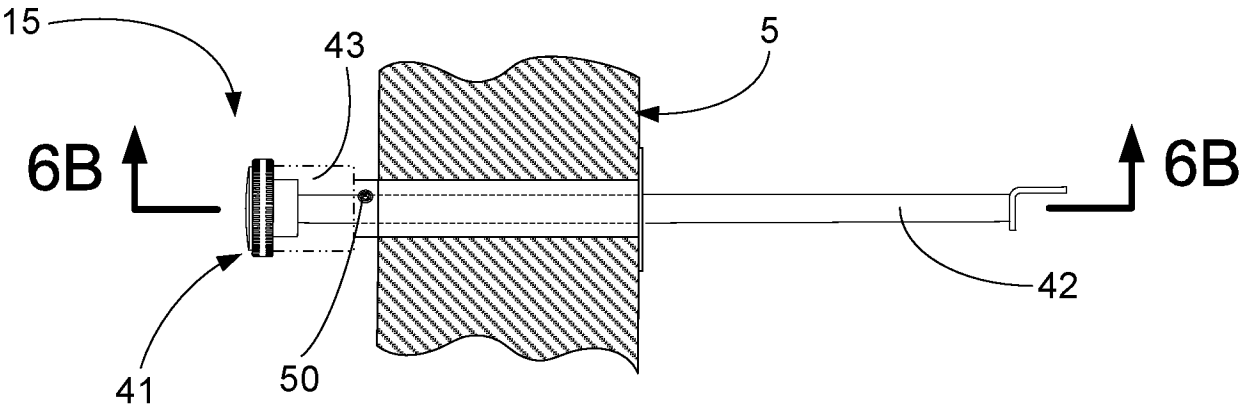
FIG. 6A is a view, partially in cross-section, of a seal actuating assembly in a seal closed position, in accordance with certain embodiments.
Figure 6C:
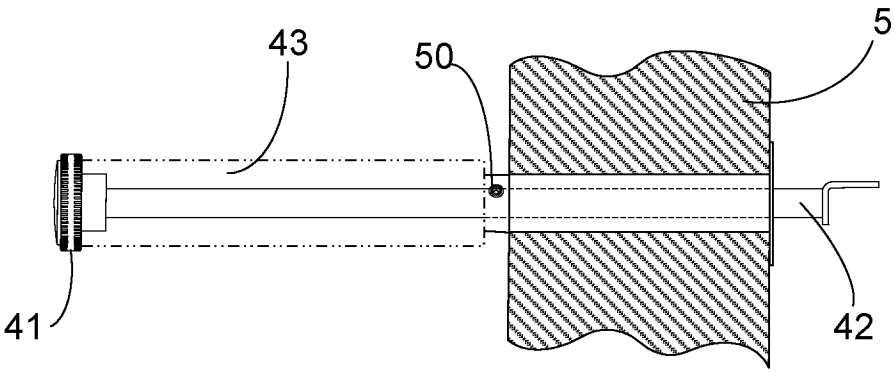
FIG. 6C is a view of the actuating assembly of FIG. 6A in a seal open position, in accordance with certain embodiments.

Turning now to FIG. 6A, in certain embodiments the actuator assembly 15 includes a handle or knob 41 that is preferably constructed of an insulating material such as a phenolic. The handle 41 facilitates the manual gripping of the actuator assembly 15 to actuate a seal member 30. The handle is coupled to a handle rod 42 that extends through the dryer wall 5 into the interior of the dryer housing 10, and connects to a respective actuator rod 40 or 40' depending on whether it is actuating a seal member 30 or 30'. In order to limit heat conduction from the interior of the dryer housing 10, in certain embodiments the handle rod 42 is constructed of thin-wall 300 series stainless steel tubing. In certain embodiments, in order to prevent contact with the surface of the handle rod 42, a compressible protective cover 43 such as a silicone-coated fiberglass fabric or the like may be positioned over the rod 42 between the handle 41 and the exterior of the dryer wall 5. The cover 43 is shown in a compressed state in FIG. 6A (e.g., the seal member closed position), and in an expanded state in FIG. 6C (e.g., the seal member open position). A locking mechanism 50 may be used to lock the seal member 30 in place, either in the seal member open position or the seal member closed position. For example, the locking mechanism may include a split shaft collar design or a set screw or the like that prevents movement of the rod 42.

Turning back to FIGS. 3A and 3B, it can be seen that each of the actuator rods 40, 40' is slidingly received by one or bushings or guide members 45. In certain embodiments, the guide members 45 may be secured to the side of a nozzle 20, or to the nozzle header, such as by welding. As the actuators 15*a*, 15*b* are moved from the seal member closed position of FIG. 3A to the seal member open position of FIG. 3B (and vice versa), the actuator rods 40, 40' slide within the guide members 45 which help maintain proper alignment. This helps ensure that when the seal member is in the closed position, it properly aligns with and blocks the discharge opening. Where more than one guide member 45 is used for an actuator rod 40 or 40', they are linearly aligned.

In certain embodiments, manual actuation of the actuators 15*a*-15*n* results in linear translation of the respective seal members 30, 30' associated with the actuators, thereby controlling or regulating the extent of air flow blockage from one or more nozzles, and thus the extent of air flow discharged from non-blocked regions of the nozzle(s). Webs of different widths can be easily accommodated by the dryer without requiring access to the dryer interior or ceasing drying operations. The web width can be a known parameter to the operator, or can be sensed with suitable sensors in the dryer or upstream of the dryer.

Figure 7:
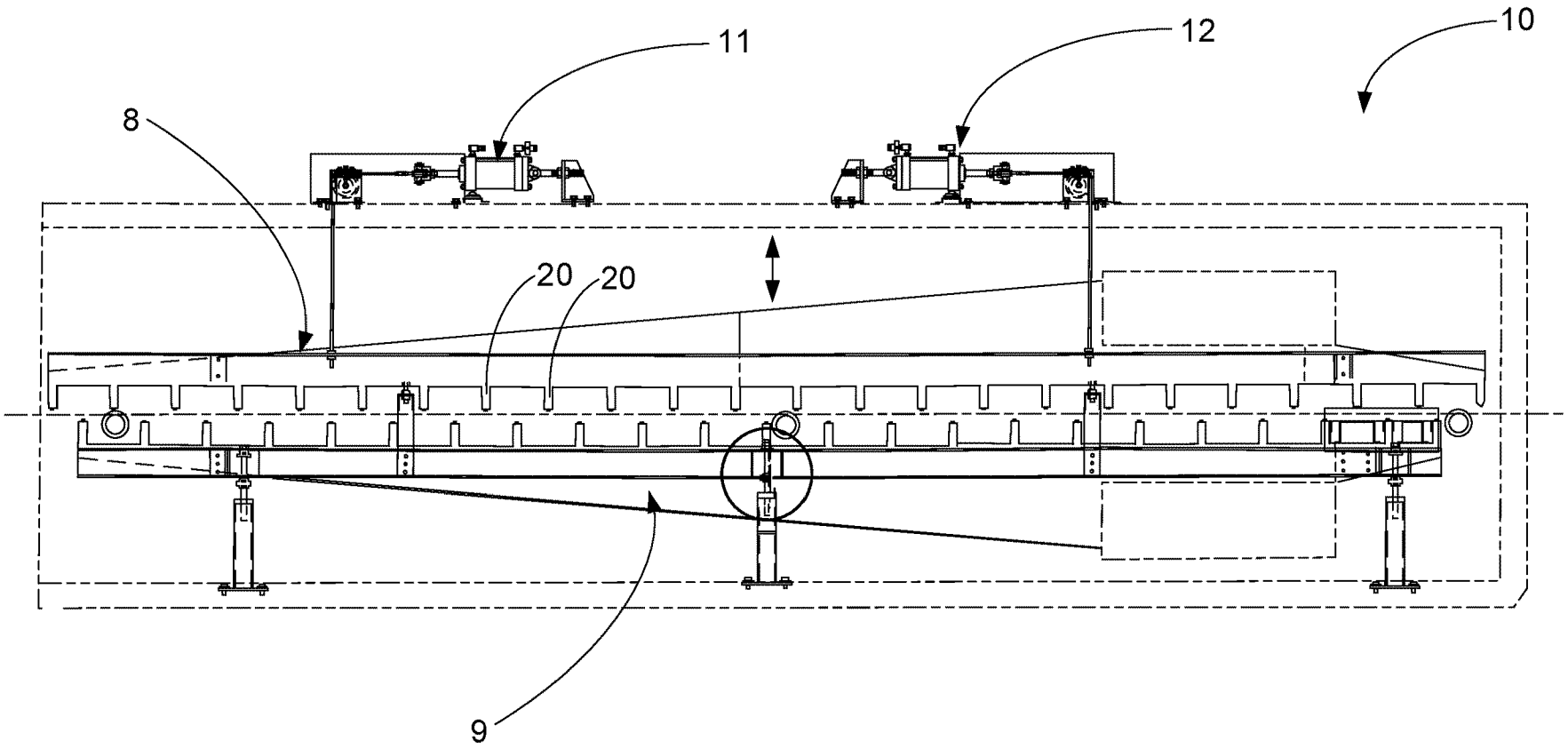
FIG. 7 is a schematic diagram of a dryer showing a retractable upper air bar header and a stationary lower air bar header in accordance with certain embodiments.

Certain nozzle assemblies in dryers have height-varying provisions, whereby the assemblies can be retracted by suitable retraction actuation devices, such as actuators 11, 12 (as shown in FIG. 7). The remote nozzle deckle system of the embodiments disclosed herein is versatile enough to be used with retractable nozzle assemblies. For example, as shown in FIG. 7, the upper nozzle assembly 8 can be moved vertically (e.g., with respect to the lower nozzle assembly 9) with actuators 11, 12. The actuator rods 40, 40' linking the actuating handles 41 to the seal members 30, 30' can be modified to accommodate this motion. FIGS. 4A and 4B illustrate one embodiment of such a modification. Thus, the actuating mechanism is similar to that shown in FIGS. 3A and 3B, except that linking members 48 are provided, linking respective handle rods 42 to respective actuator rods 40, 40'. With respect to seal member 30 (the seal member closest to the operator side of the dryer housing 10), linking member 48 is pivotally connected to actuator rod 40 at pivot point 49. With respect to the seal member 30' (the seal member closest to the gear side of the dryer housing 10), linking member 48' is pivotally connected to actuator rod 40' at pivot point 49'. Linking member 48 (or 48') may be bent, if necessary, to accommodate the retraction of the nozzle assembly.

Figure 8:
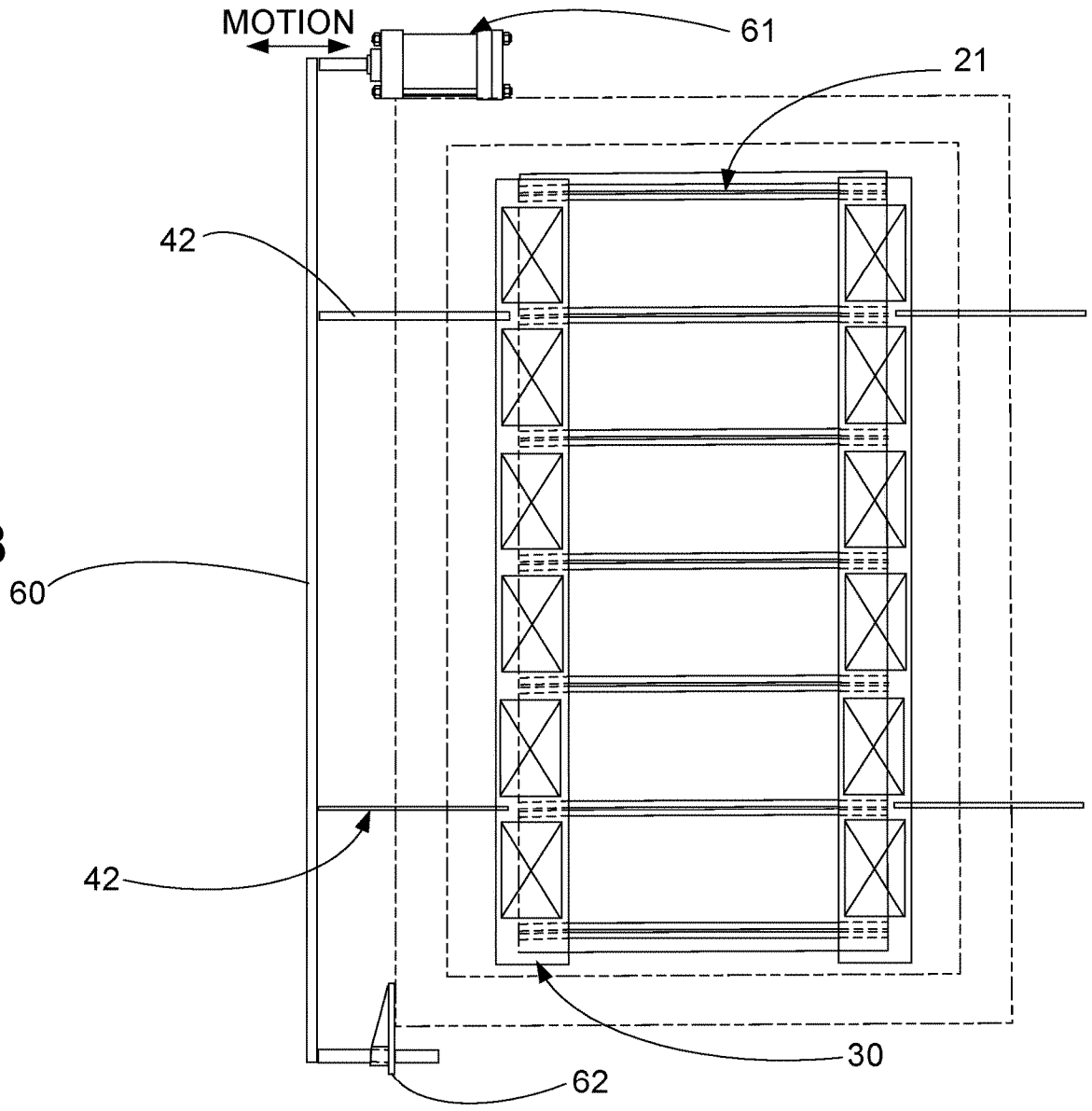
FIG. 8 is a schematic diagram of a nozzle assembly with an automatic actuating mechanism.

FIG. 8 shows an embodiment where one or more seal members 30 are actuated automatically rather than manually. In certain embodiments, a connector bar 60 is coupled to each handle rod 42 devoid of handle 41. Connector bar 60 is coupled to actuator 61. Linear bearing 62 may be provided to ensure alignment. Actuating the actuator 61 causes simultaneous movement of each handle rod 42 due to their attachment to connector bar 60, which in turn adjusts the position of each seal member 30, 30'.

While various aspects and embodiments have been disclosed herein, other aspects, embodiments, modifications and alterations will be apparent to those skilled in the art upon reading and understanding the preceding detailed description. The various aspects and embodiments disclosed herein are for purposes of illustration and are not intended to be limiting. It is intended that the present disclosure be construed as including all such aspects, embodiments, modifications and alterations insofar as they come within the scope of the appended claims or the equivalents thereof.

What is claimed is:

1. Web handling apparatus comprising a housing; at least one nozzle in said housing, said at least one nozzle having a nozzle body and a free end and a discharge opening at said free end positioned to discharge air from said nozzle into said housing such that the air discharged from said discharge opening is no longer confined by said nozzle body; and at least one seal member positioned externally to said nozzle body and movable between a first position where said seal member blocks a first region of said discharge opening in said at least one nozzle and a second position where said seal member does not block said discharge opening in said at least one nozzle.

2. The apparatus of claim 1, wherein said housing comprises a plurality of nozzles each of said nozzles having a free end with discharge openings at said free end positioned to discharge air from said nozzle into said housing, and wherein said first position of said seal member blocks a region of said discharge opening in each of said plurality of nozzles.

3. The apparatus of claim 1, wherein said seal member is movable from outside of said housing.

4. The apparatus of claim 1, wherein said discharge opening comprises an elongated slot.

5. The apparatus of claim 1, further comprising a second seal member movable between a third position where said second seal member blocks a second region of said discharge opening in said at least one nozzle and a fourth position where said second seal member does not block said discharge opening in said at least one nozzle.

6. The apparatus of claim 1, wherein said housing further comprises an upper array of nozzles and a lower array of nozzles, and a running web between said upper and lower arrays.

7. The apparatus of claim 1, wherein said seal member comprises at least one blocking finger for blocking said first region of said discharge opening when said seal member is in said first position.

8. The apparatus of claim 1, wherein said seal member is coupled to an actuator.

9. The apparatus of claim 1, wherein said housing comprises a wall, and wherein said at least one nozzle is positioned in said housing spaced from said wall to define a region between said nozzle and said wall of sufficient dimensions to accept said seal member when in said second position.

10. The apparatus of claim 1, wherein said web handing apparatus comprises a dryer.

11. The apparatus of claim 1, wherein at least one locking mechanism is used to lock at least one seal member in place, either in the seal member first position or second position.

12. The apparatus of claim 1, wherein said seal member comprises at least one actuator member for moving said seal member from said first position to said second position.

13. The apparatus of claim 12, wherein said housing has a web path for travel of a web, and wherein there are a plurality of nozzles in said housing, positioned in a first array above said web path and in a second array below said web path, said first and second arrays being retractable with respect to each other, and wherein said at least one actuator member can accommodate said retraction.

14. The apparatus of claim 12, further comprising at least one guide member cooperating with said actuator member to ensure proper alignment of said seal member with respect to said discharge opening when said seal member is in said first position.

15. The web handling apparatus of claim 1, wherein said at least one nozzle has a top surface, and wherein said at least one seal member is positioned on said top surface when in said first position.

16. A method of controlling air emitted from a nozzle in a housing, comprising:

a. providing a housing defining a chamber;

b. providing a source of air;

c. providing at least one nozzle in said housing in fluid communication with said source of air, said at least one nozzle having a nozzle body and a free end and a discharge opening at said free end positioned to discharge air from said at least one nozzle into said chamber such that the air discharged from said discharge opening is no longer confined by said nozzle body;

d. providing a seal member in said housing and external to said nozzle body; and e. moving said seal member into position with respect to said nozzle to block a portion of said air discharged through said discharge opening.

17. The method of claim 16, wherein said seal member is moved with an actuator outside of said housing.

18. The method of claim 16, wherein said discharge opening comprises an elongated slot.

19. The method of claim 16, further comprising providing a web having a web width, and wherein said step of moving said seal member is in response to the width of said web.

20. The method of claim 16, wherein there are a plurality of nozzles each having respective free ends with discharge openings, and wherein said seal member is moved to block a portion of said air discharged through the discharge openings in each of said plurality of nozzles.

21. The method of claim 16, further comprising providing a second seal member, and moving said second seal member into position with respect to said nozzle to block a further portion of said air discharged through said discharge opening.

22. The method of claim 16, wherein said at least one nozzle has a top surface, and wherein said at least one seal member is positioned on said top surface when in said first position.

* * * * *